US008844182B2

(12) United States Patent
Ibarguren

(10) Patent No.: US 8,844,182 B2
(45) Date of Patent: Sep. 30, 2014

(54) BOLT ASSEMBLY FOR A FIREARM

(71) Applicant: Dikar S. Coop. Ltda, Bergara (ES)

(72) Inventor: Inigo Lizarralde Ibarguren, Bergara (ES)

(73) Assignee: Blackpowder Products, Inc., Duluth, GA (US)

( * ) Notice: Subject to any disclaimer, the term of this patent is extended or adjusted under 35 U.S.C. 154(b) by 101 days.

(21) Appl. No.: 13/780,369

(22) Filed: Feb. 28, 2013

(65) Prior Publication Data

US 2013/0219764 A1 Aug. 29, 2013

(30) Foreign Application Priority Data

Feb. 28, 2012 (EP) ..... 12380010

(51) Int. Cl.

| | |
|---|---|
| ***F41A 3/00*** | (2006.01) |
| ***F41A 17/42*** | (2006.01) |
| ***F41A 3/18*** | (2006.01) |
| ***F41A 3/36*** | (2006.01) |

(52) U.S. Cl.

CPC . *F41A 3/36* (2013.01); *F41A 17/42* (2013.01); *F41A 3/18* (2013.01)

USPC ..... 42/16; 42/70.11; 42/106

(58) Field of Classification Search

CPC ..... F41A 11/00; F41A 11/02; F41A 15/12; F41A 15/14; F41A 3/18; F41A 3/36; F41A 17/42

USPC ..... 42/1.01, 16, 25, 70.11, 106

See application file for complete search history.

(56) References Cited

U.S. PATENT DOCUMENTS

| | | | | |
|---|---|---|---|---|
| 3,595,128 | A * | 7/1971 | Hoyt, Jr. | 89/12 |
| 3,696,542 | A * | 10/1972 | Ekfeldt et al. | 42/16 |
| 4,672,762 | A * | 6/1987 | Nilsson | 42/70.01 |
| 5,722,194 | A * | 3/1998 | Wurger et al. | 42/69.02 |
| 7,975,417 | B2 * | 7/2011 | Duplessis et al. | 42/16 |
| 8,522,465 | B2 * | 9/2013 | Jarboe et al. | 42/16 |
| 2003/0089014 | A1 * | 5/2003 | Schuerman | 42/16 |
| 2010/0257768 | A1 * | 10/2010 | Barrett | 42/16 |
| 2011/0168009 | A1 * | 7/2011 | Robb et al. | 89/194 |
| 2012/0137557 | A1 * | 6/2012 | Klotz | 42/16 |

* cited by examiner

*Primary Examiner* — Gabriel Klein

(74) *Attorney, Agent, or Firm* — Gardner Groff Greenwald & Villanueva, PC

(57) ABSTRACT

A bolt assembly for a firearm, wherein the bolt assembly is intended to move inside an inner cavity of a receiver of the firearm and comprises a body, a removable bolt head, at least one protruding element that tends to protrude elastically from the body, so that when allowed to protrude elastically unhindered, the bolt assembly cannot be inserted inside the inner cavity of the receiver. The connection of the bolt head to the body causes the protruding element to elastically contract, enough to allow the bolt assembly to be inserted inside the inner cavity of the receiver. Thus, a single elastic protruding element enables the user to be warned if trying to assemble the body without the bolt head into the receiver.

18 Claims, 5 Drawing Sheets

BOLT ASSEMBLY FOR A FIREARM

CROSS-REFERENCE TO RELATED APPLICATION

This application claims the benefit of European Patent Application No. EP 12380010.4 filed Feb. 28, 2012, the content of which is hereby incorporated herein by reference in its entirety.

TECHNICAL FIELD

The invention relates generally to firearms, and more particularly to a bolt assembly for a firearm, such as a bolt-action or semiautomatic rifle or shotgun.

BACKGROUND

A rifle is a firearm characterized in having a relatively long barrel that allows highly accurate shooting to be carried out from a long distance. Among the different types of known rifles is the bolt-action rifle, which is named so because it includes a part similar to the bolts of old manual locks, i.e. an elongated rod-shaped part, with a bolt handle, which the user manually moves inside another part called the receiver in order to use the rifle. More specifically, the bolt is manually opened after shooting, usually by pulling it backwards, in order to eject the used shell or casing from inside the receiver. Once the receiver has been loaded with a new shell (either manually or automatically), the bolt is pushed forward inside the receiver in order to load the rifle with the new shell and to load the spring unit and firing pin responsible for hitting the back of the shell during firing.

Traditionally, the bolt was composed of a single elongated part provided with a bolt handle in the area of the bolt intended to be located most distant from the rifle barrel. However, new concepts are known where the bolt is divided into several parts, due to different interests. For example, concepts are known in which the bolt handle is removable (see, for instance, U.S. Pat. No. 7,950,177). Other concepts are known in which the elongated body of the bolt is composed of several parts fixed together. For example, bolts comprising a removable bolt head are known (see, for instance, European patent application EP0163129).

Having a bolt with a removable bolt head presents a significant advantage. Legislation in some countries mandates that each rifle is only allowed to have one bolt, and providing a bolt with the possibility of having removable and replaceable bolt heads allows a single bolt to be adapted for different calibre ammunition shells without breaching the aforementioned regulations.

The fact that the bolt head is removable from the bolt is not, however, without risk. In the event that the user of the rifle forgets to fix the bolt head to the bolt body and inserts the bolt body into the receiver without the bolt head, serious accidents could take place during firing. More specifically, the rear area of the shell would not be secured by the bolt because the bolt would be lacking the bolt head on its end and would therefore be shorter than the correct length; then, when firing took place, the pressure created in the chamber would push the bullet forward but, at the same time, as the rear part of the shell would not be secured, the resulting pressure would push this shell backwards. One or more of the following could then happen: the shell could split and small fragments could be expelled through the apertures in the action; the jet of hot air generated by the shot could also be expelled though the apertures; the shall case could push the firing pin backwards and the firing pin could be projected outwardly towards the shooter's face; the entire bolt could come out backwards.

Thus it has been discovered that needs exist for mechanisms to prevent the user of a bolt-action rifle or other firearm equipped with a removable bolt head from being able to assemble the bolt inside the receiver without the bolt head. It is to the provision of a firearm meeting these and other needs that the invention is primarily directed.

SUMMARY

In example forms, the invention relates to a firearm such as a bolt-action rifle having a bolt assembly adapted to move within an inner cavity of the rifle part known as the receiver or action. The bolt assembly includes at least one bolt body and a removable bolt head. In addition, the bolt assembly according to example forms of the invention has the particularity that it includes at least one protruding element that tends to protrude elastically from the body, so that when allowed to protrude elastically unhindered, the bolt assembly cannot be inserted inside the inner cavity of the receiver. This means that the bolt assembly includes a protruding element that, in principle, prevents the bolt assembly from being inserted inside the rifle receiver. On another hand, the connection of the bolt head to the body causes the protruding element to contract elastically, enough to allow the bolt assembly to be inserted inside the inner cavity of the receiver. This means that the only way of being able to smoothly insert the bolt assembly into the receiver is if the bolt head is correctly assembled onto the body of the bolt assembly, so that the protruding element becomes elastically contracted or retracted and the bolt assembly then fits inside the receiver.

The above solution ensures that the bolt assembly is always fully assembled, including the bolt head, before being inserted into the receiver. The risk that the user might forget to assemble the bolt head and an accident might occur on firing no longer exists.

The protruding element preferably comprises a cantilever spring that juts out from the surface of the bolt assembly. When the bolt head is connected onto the body of the bolt assembly, this cantilever spring is inserted into a reception area comprised in the bolt head. This solution, in which the protruding element is a single cantilever spring, capable of engaging in a reception area in the bolt head and staying folded, is a solution that is effective, simple to manufacture, and easy and intuitive to use.

In a further aspect, the invention relates to a firearm including a barrel, a receiver defining an internal channel, and a bolt for sliding engagement with the internal channel of the receiver. The bolt preferably includes a bolt body and a removable head portion, and further includes a bolt blocking member movable between a first position allowing engagement of the bolt with the receiver when the bolt head is properly installed on the bolt body, and a second position resisting engagement of the bolt with the receiver when the bolt head is not properly installed on the bolt body.

In another aspect, the invention relates to a bolt assembly for a firearm. The bolt assembly preferably includes a bolt body, and a bolt head removably attachable to the bolt body. A protruding element is preferably coupled to the bolt body and is movable between a retracted position when the bolt head is properly attached to the bolt body, and an extended position when the bolt head is not properly attached to the bolt body.

In still another aspect, the invention relates to a method of preventing installation of a bolt assembly into a receiver of a firearm when a removable bolt head portion of the bolt assembly is not properly attached to a bolt body portion of the bolt assembly. The method preferably includes the steps of providing a protruding element movable between a retracted position and an extended position, allowing movement of the protruding element to the retracted position when the bolt head is properly attached to the bolt body, and allowing movement of the protruding element to the extended position when the bolt head is not properly attached to the bolt body.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are exemplary and explanatory of preferred embodiments of the invention, and are not restrictive of the invention, as claimed.

BRIEF DESCRIPTION OF THE DRAWINGS

Details of the invention can be seen by way of example embodiments in the accompanying drawings, which do not seek to restrict the scope of the invention.

DETAILED DESCRIPTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
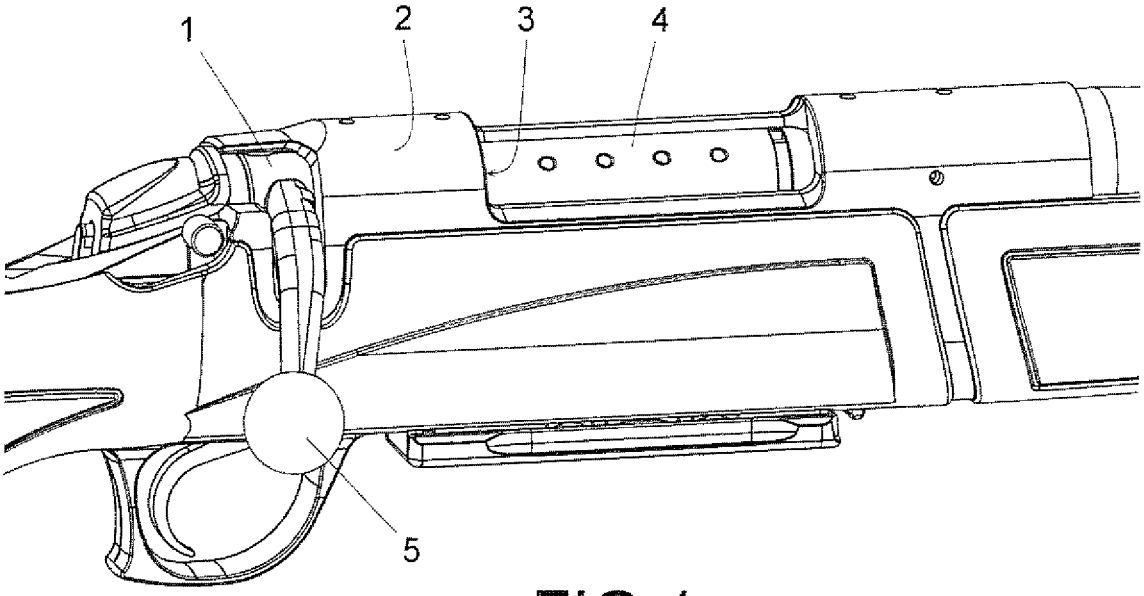
FIG. 1 shows a partial perspective view of the area of a bolt-action rifle where an embodiment of the bolt assembly according to the invention is located.

FIG. 1 shows a partial perspective view of a bolt-action rifle, more specifically of the area of the rifle where an embodiment of the bolt assembly according to the invention is located. In the figure, the bolt assembly (1) is fully inserted into the rifle receiver (2), more specifically in an inner cavity (3) of the receiver. The bolt assembly (1), like other bolt assemblies known in the state of the art, comprises an elongated body (4) and a removable bolt head, the bolt head not being visible as it is inside the receiver (2). In addition, the bolt assembly (1) comprises a bolt handle (5), which the user operates to actuate the bolt to unload a spent cartridge casing or shell and to load a new cartridge into the chamber between two consecutive shots by partially rotating, retracting, advancing and counter-rotating the bolt action.

Figure 2A:
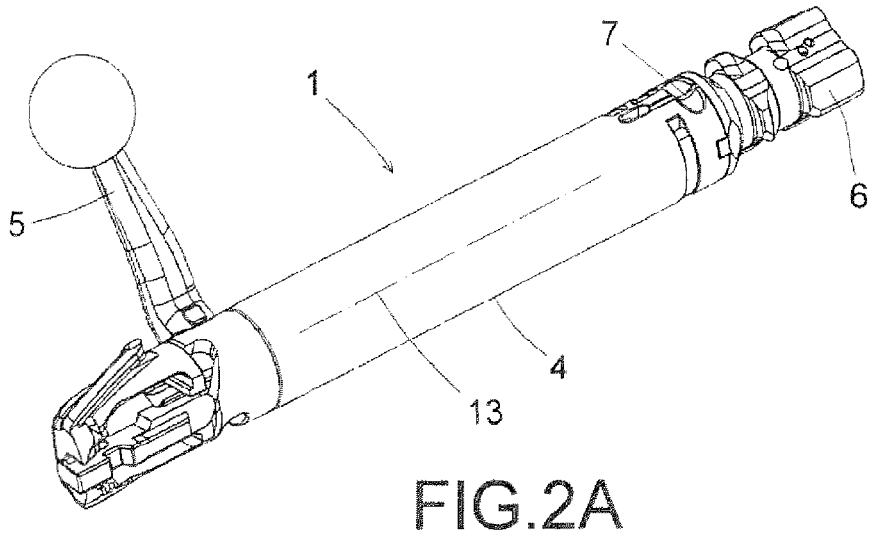
FIGS. 2A and 2B each show perspective views of the bolt assembly of the previous figure, with the bolt head respectively assembled and disassembled in relation to the body of the bolt assembly.
Figure 2B:
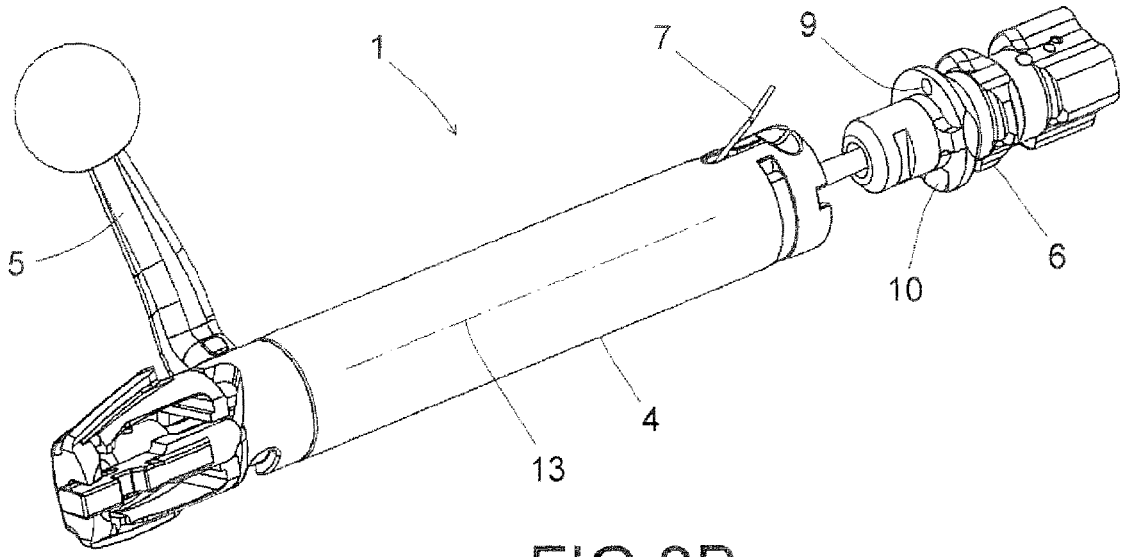

FIGS. 2A and 2B show the bolt assembly (1) of the previous figure. As can be seen, the bolt assembly (1) comprises the bolt body (4), the bolt handle (5) and a bolt head (6), which is removable from the body (4) (the bolt head (6) being shown assembled in FIG. 2A and disassembled in FIG. 2B). With the purpose of preventing the bolt assembly (1) without the bolt head (6) from being able to be inserted conveniently and easily into the inner cavity (3) of the receiver (2), the bolt assembly (1) further comprises a protruding element (7) that tends to protrude elastically from the body (4).

Figure 3:
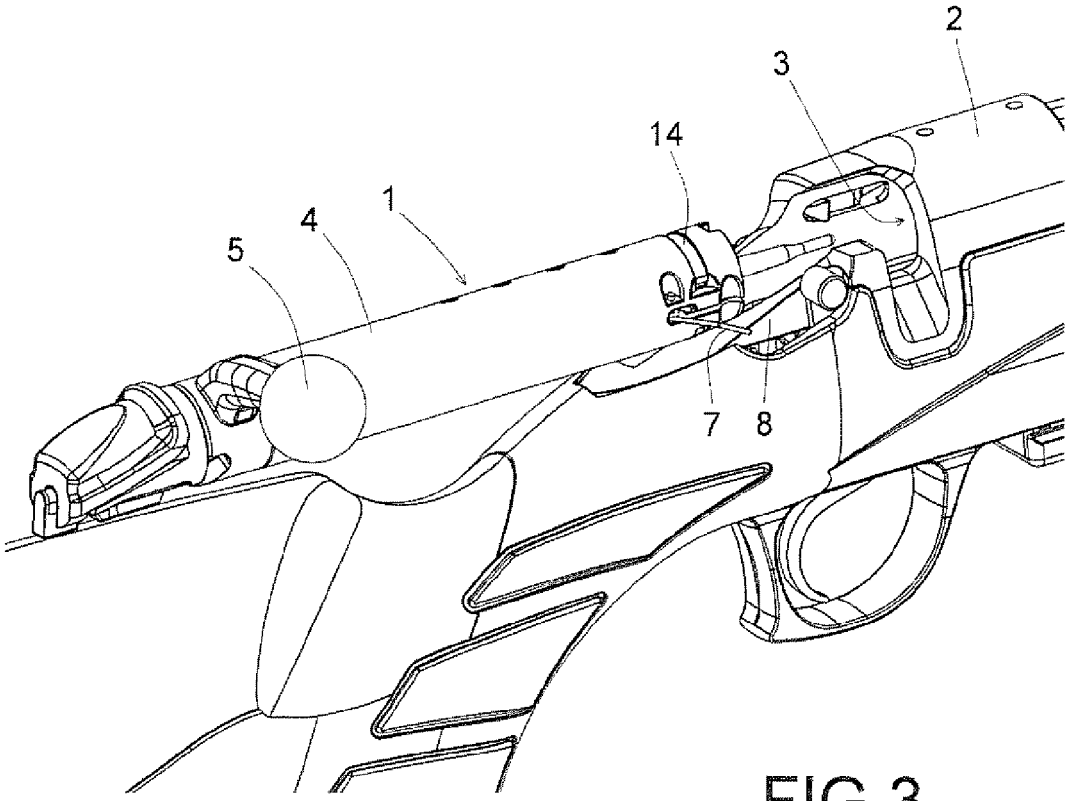
FIG. 3 shows a perspective view of the bolt assembly without the bolt head trying to be inserted into the receiver, said insertion being prevented by the protruding element.

When the protruding element (7) is allowed to stand out elastically unhindered, the bolt assembly (1) cannot be inserted inside the inner cavity (3) of the receiver (2). This fact can be seen in FIG. 3, in which the bolt assembly (1) has been represented without the bolt head (6) and trying to be inserted into the inner cavity (3) of the receiver (2). The protruding element (7), which is extended, collides with a wall (8) of the receiver (2), acting as a stop that prevents the bolt assembly (1) from being inserted.

On the other hand, if the bolt head (6) is assembled on the body (4), the assembly according to the invention is carried out so that the protruding element (7) elastically contracts, enough to allow the bolt assembly (1) to be inserted inside the inner cavity (3) of the receiver (2). This fact can be understood from FIG. 4, in which the bolt assembly (1) has been represented with the bolt head (6) and trying to be inserted into the inner cavity (3) of the receiver (2). As shown in this figure, the protruding element (7) is folded against the body (4) and no longer collides with the wall (8) nor prevents the bolt assembly (1) from being inserted into the inner cavity (3) of the receiver (2).

Thus, by means of an elastic protruding element (7) that folds back or retracts only if the bolt head (6) is properly connected to the body (4) and that only protrudes and acts as a stop if the bolt head (6) is disconnected from the body (4), a simple and effective way of fulfilling the goals of the invention is achieved. The user cannot easily insert the bolt assembly (1) without the bolt head (6) into the receiver (2): firstly, the user will perceive that the protruding element (7) collides with the wall (8); secondly, and assuming that the user applies a high enough force for the protruding element (7) to pass the stop formed by the wall (8), the user will perceive a second stop when the bolt assembly (1) reaches the end of the receiver (2) and the user tries to turn the bolt assembly (1) clockwise in order to reach the loading position shown in FIG. 1. Optionally, the protruding element (7) may be of a highly visible or contrasting color or material of composition relative to surrounding portions of the bolt and receiver to provide a visual alert to the user that the bolt head (6) is not properly installed. As a result, it turns out to be impossible for the user to succeed in loading the rifle without realizing at some point that the bolt head (6) is dismantled from the bolt assembly (1).

Figure 4:
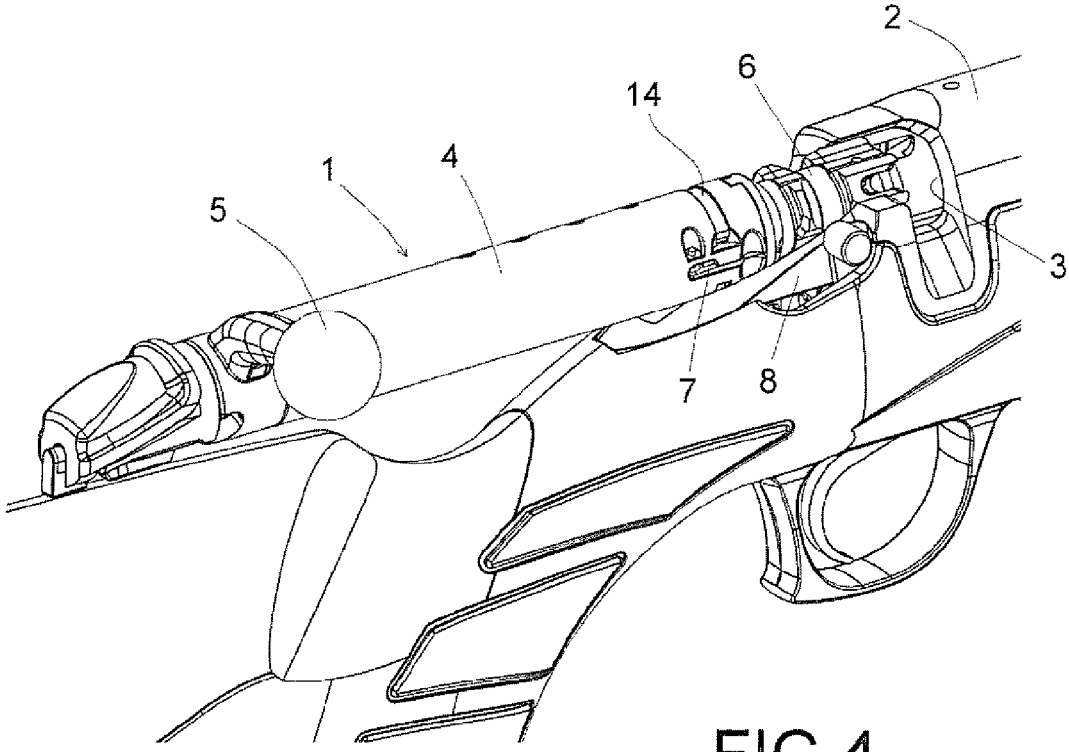
FIG. 4 shows a perspective view similar to FIG. 3, but with the bolt head, insertion now being possible because the protruding element is folded against the body.

Preferably, as shown in FIGS. 2A and 4, the protruding element (7) comprises a cantilevered spring or finger that juts out from the body (4), for example under its own internal resilience or material bias. In turn, the bolt head (6) includes a reception area or recess (9) capable of receiving the cantilever spring. Then, when the user connects the bolt head (6) to the body (4) of the bolt assembly (1), the user flexes the cantilever spring and manually inserts the end of it into the reception area (9), with the spring remaining engaged and in the folded position. In this way, the cantilever spring is put in a position that does not prevent the bolt assembly (1) from being inserted into the receiver (2). This operation of assembling the bolt head (6) and engaging the end of the cantilever spring into the reception area (9) is very simple and intuitive for the user. Besides, it is clear that the use of a cantilever spring is a very simple, economical and effective solution.

Figure 5:
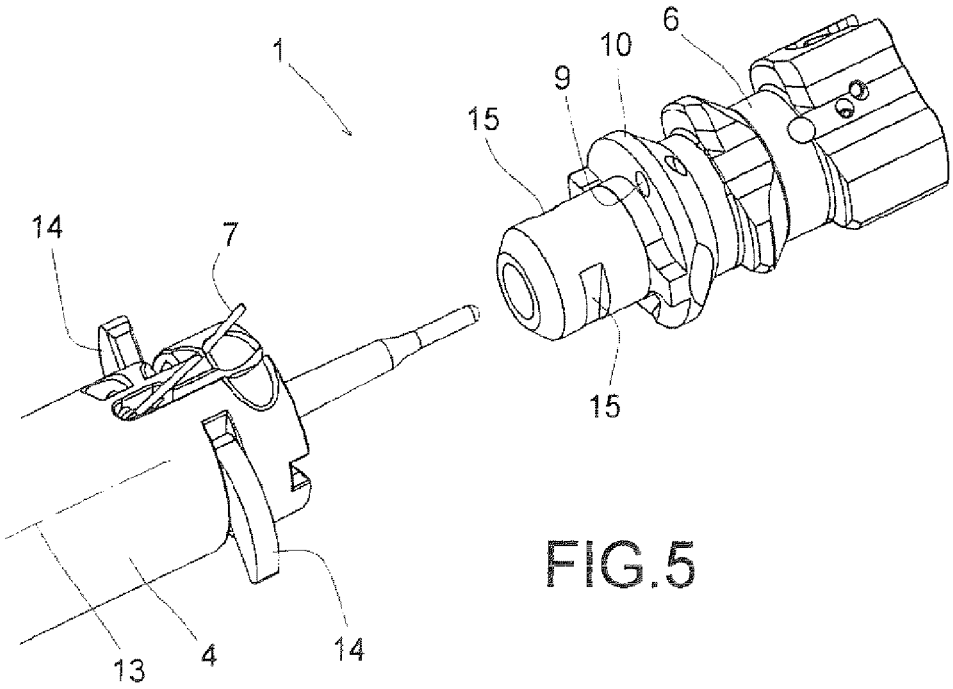
FIG. 5 shows an enlarged view of the bolt head and the end of the body to which the bolt head is to be connected.

FIG. 5 shows an enlarged view of the bolt head (6) and of the end of the body (4) to which the bolt head (6) is to be connected. As can be seen, the reception area (9) of the bolt head (6) comprises, in this embodiment, a hole made in a protruding area (10) of the bolt head (6). This solution is advantageous because machining a hole in a protruding area (10) is an easy-to-perform operation and therefore the manufacture cost of the bolt head (6) is not significantly increased. The hole is preferably a through hole, as represented in the figure, which is advantageous because the hole is then relatively long and allows the spring to be relatively long, with higher dimensional tolerances, thereby facilitating production. Alternatively the hole can be a blind hole of sufficient depth to receive the protruding element.

Figure 6:
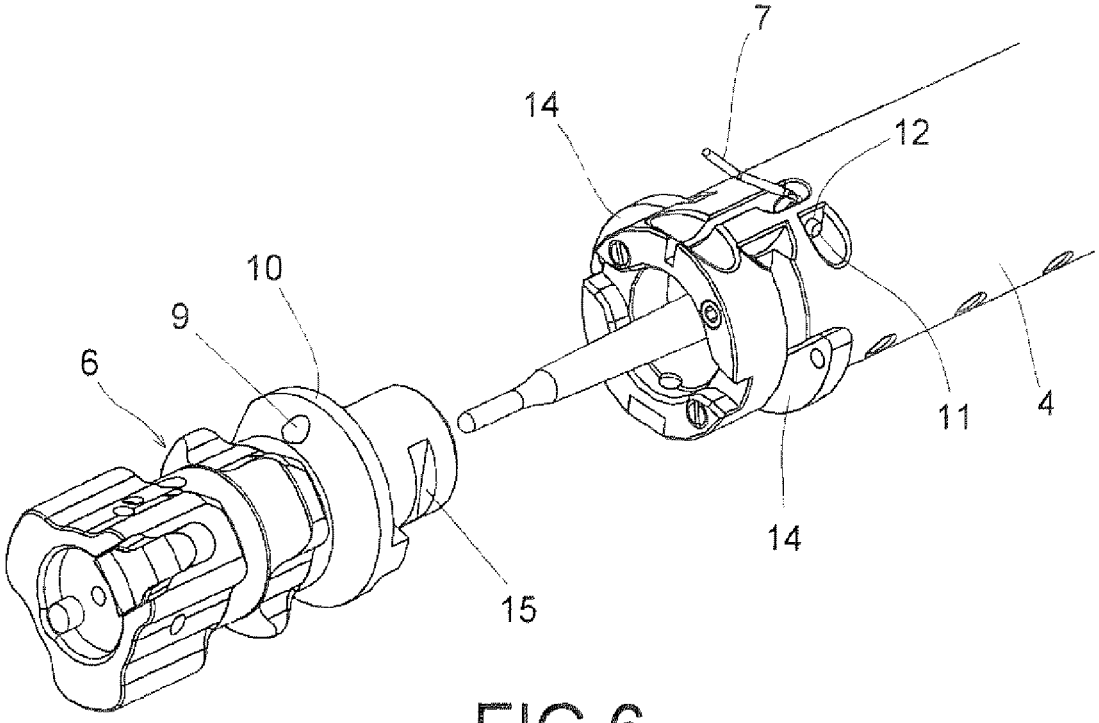
FIG. 6 shows a similar view to the previous figure, but seen from an opposite point of view.
Figure 7:
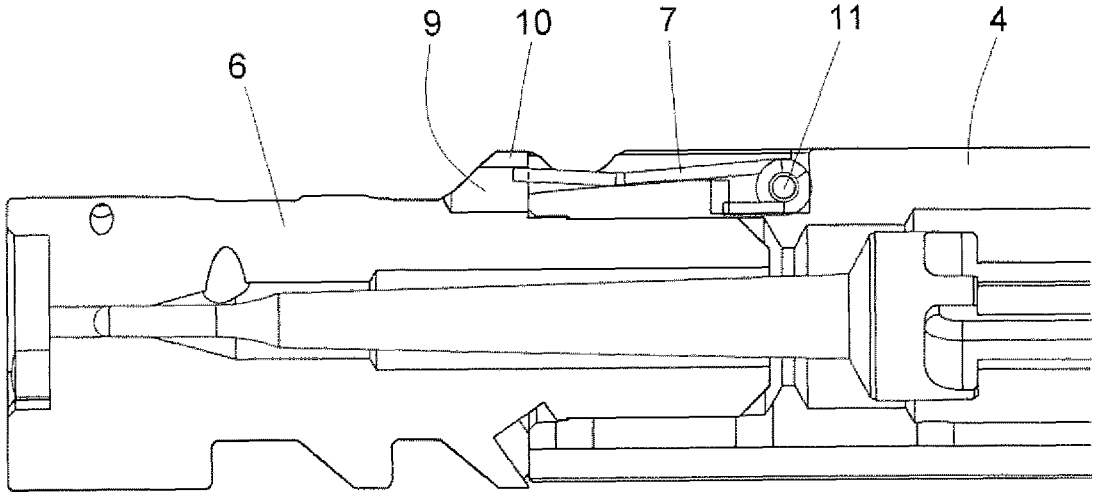
FIG. 7 shows a schematic cross section of the front area of the bolt assembly, with the bolt head assembled on the body.

On the other hand, FIG. 5 and especially FIGS. 6 and 7 make it possible to see that the protruding element (7) or cantilever spring has one end fixed to a pin (11) secured to the body (4), where this pin (11) is lodged in a blind hole (12) in the body (4). The pin (11) lodged in the blind hole (12) is a safe and effective solution because once the pin (11) has been inserted into the blind hole (12) and the protruding element (7) has been engaged to the pin (11), it is virtually impossible to extract the pin (11) from the blind hole (12) in order to release the protruding element (7). The solution based on a cantilever spring engaged to a pin (11) is not only effective but also very simple and economical to manufacture because it requires only two parts, each of whose geometry is also very simple.

In the embodiment shown in the figures, the protruding element (7) tends to stand out from the body (4) both radially and longitudinally. Radially is understood to mean in a direction perpendicular or transverse to the longitudinal axis (13) of the body (4), while longitudinally is understood to mean in a direction along or parallel to this longitudinal axis (13). The advantage of this option is that if the bolt head (6) is not assembled, the protruding element (7) interferes with the receiver (2) both on inserting the body (4) longitudinally, and when trying to rotate the body (4) in the final part of the loading or bolt locking process.

The invention contemplates other alternative embodiments to the one shown. For example, the protruding element (7) might only stand out from the body (4) longitudinally. Alternatively, the protruding element (7) might only stand out from the body (4) radially. In further alternate embodiments, the protruding element (7) comprises a pivotally and/or translationally mounted member operable by a directly or indirectly coupled linkage to move to an extended or blocking position that prevents insertion of the bolt into the receiver when the bolt head is removed or improperly installed, and to move to a retracted or non-blocking position that allows insertion of the bolt into the receiver when the bolt head is properly installed.

On another hand, as shown in FIGS. 5 and 6, the body (4) includes at least one hinged part (14) in relation to said body, and the bolt head (6) includes at least one corresponding notch (15). When the bolt head (6) is assembled on the body (4), the hinged part (14) folds down against the body (4) and becomes partially inserted inside the notch (15), thereby locking the bolt head (6) in relation to the body (4). If the hinged parts (14) are not fully inserted, these same hinged parts (14) prevent the bolt assembly (1) from being assembled in the receiver (2). FIG. 4 shows the hinged part (14) in its final position, folded down against the body (4). In a hollow internal area of the body (4), not visible in the figure, in which the end of the bolt head (6) is housed, the inner part of the hinged parts (14) is lodged in the respective notches (15).

All patents and publications referred to herein are hereby incorporated herein by reference in their entireties. Also, while described herein with respect to example embodiments relating to manually actuated bolt-action rifles, it will be understood that the present invention may be adapted to use in connection with rifles, shotguns or other firearms of manual, automatic or semi-automatic varieties having a movable bolt with a removable bolt head, and embodiments of such are within the scope of the invention unless specifically excluded in the following claims. While the invention has been described with reference to preferred and example embodiments, it will be understood by those skilled in the art that a variety of modifications, additions and deletions are within the scope of the invention, as defined by the following claims.

The invention claimed is:

1. A bolt assembly for a firearm, where the bolt assembly is configured to move inside an inner cavity of a receiver of the firearm and comprises a body and a removable bolt head, and further comprising:

at least one protruding element that tends to protrude elastically from the body, so that when allowed to protrude elastically, the bolt assembly cannot be inserted inside the inner cavity of the receiver, wherein a connection of the bolt head to the body causes the protruding element to contract elastically, enough to allow the bolt assembly to be inserted inside the inner cavity of the receiver; and wherein the protruding element automatically protrudes from the body when the bolt head is disconnected from the body.

2. The bolt assembly of claim 1, wherein the protruding element comprises a cantilever spring that protrudes from the body, and wherein said cantilever spring, when the bolt head is connected to the body of the bolt assembly, is inserted into a reception area in the bolt head.

3. The bolt assembly of claim 2, wherein the protruding element has one end fixed to a pin secured to the body, wherein said pin is lodged in a blind hole in the body.

4. The bolt assembly of claim 2, wherein the reception area comprises a hole made in a protruding area of the bolt head.

5. The bolt assembly of claim 4, wherein the hole is a through hole.

6. The bolt assembly of claim 1, wherein the protruding element tends to protrude radially from the body.

7. The bolt assembly of claim 1, wherein the protruding element tends to protrude longitudinally from the body.

8. The bolt assembly of claim 1, wherein the protruding element tends to protrude radially and longitudinally from the body.

9. The bolt assembly of claim 1, wherein the body comprises at least one hinged part in relation to said body, and the bolt head comprises at least one corresponding notch, and wherein when the bolt head is assembled on the body the hinged part folds down against the body and becomes partially inserted inside the notch, reinforcing the connection between the body and the bolt head.

10. A firearm comprising:

a barrel;

a receiver defining an internal channel;

a bolt for sliding engagement with the internal channel of the receiver, the bolt comprising a bolt body, a removable head portion, and further comprising a bolt blocking member movable between a first position allowing engagement of the bolt with the receiver when the bolt head is properly installed on the bolt body, and a second position resisting engagement of the bolt with the receiver when the bolt head is not properly installed on the bolt body, wherein the bolt blocking member automatically moves from the first position to the second position when the head portion is disconnected from the bolt body.

11. The firearm of claim 10, wherein the bolt blocking member comprises a resilient finger that protrudes elastically from the bolt body in the second position.

12. The firearm of claim 10, wherein the bolt head comprises a reception area in which a cooperating portion of the bolt blocking member is retained when the bolt blocking member is in the first position and the bolt head is properly installed on the bolt body.

13. The firearm of claim 12, wherein the reception area is a hole extending through a portion of the bolt head, into which a free end of the bolt blocking member extends when the bolt blocking member is in the first position and the bolt head is properly installed on the bolt body.

14. The firearm of claim 10, comprising a bolt action rifle.

15. A bolt assembly for a firearm, said bolt assembly comprising:

a bolt body; and a bolt head removably attachable to the bolt body;

wherein a protruding element coupled to the bolt body automatically moves between a retracted position when the bolt head is properly attached to the bolt body to an extended position when the bolt head is not properly attached to the bolt body to prevent insertion of the bolt body into the receiver of the firearm when the bolt head is not properly attached to the bolt body.

16. The bolt assembly of claim 15, wherein the protruding element comprises a resilient finger that protrudes elastically from the bolt body in the extended position.

17. The bolt assembly of claim 15, wherein the bolt head comprises a reception area in which a cooperating portion of the protruding element is retained when the protruding element is in the retracted position and the bolt head is properly installed on the bolt body.

18. The bolt assembly of claim 17, wherein the reception area is a hole extending through a portion of the bolt head, into which a free end of the protruding element extends when the protruding element is in the retracted position and the bolt head is properly installed on the bolt body.

* * * * *